US009623411B1

(12) United States Patent
Frenzel et al.

(10) Patent No.: US 9,623,411 B1
(45) Date of Patent: Apr. 18, 2017

(54) METHODS AND DEVICES FOR SMALL VOLUME LIQUID CONTAINMENT

(71) Applicant: Theranos, Inc., Palo Alto, CA (US)

(72) Inventors: Gary Frenzel, Palo Alto, CA (US); Samartha Anekal, Palo Alto, CA (US); Daniel Young, Palo Alto, CA (US)

(73) Assignee: Theranos, Inc., Palo Alto, CA (US)

( * ) Notice: Subject to any disclaimer, the term of this patent is extended or adjusted under 35 U.S.C. 154(b) by 0 days.

(21) Appl. No.: 14/309,877

(22) Filed: Jun. 19, 2014

Related U.S. Application Data

(60) Provisional application No. 61/837,168, filed on Jun. 19, 2013, provisional application No. 61/837,627, filed on Jun. 20, 2013.

(51) Int. Cl.
*B01L 3/00* (2006.01)

(52) U.S. Cl.
CPC ..... *B01L 3/527* (2013.01)

(58) Field of Classification Search
CPC ..... G01N 25/02; G01N 35/02; B01L 3/527
USPC ..... 422/101, 102, 64, 552, 553, 554
See application file for complete search history.

(56) References Cited

U.S. PATENT DOCUMENTS

| | | | | |
|---|---|---|---|---|
| 6,277,646 | B1 * | 8/2001 | Guirguis et al. | 436/165 |
| 7,758,815 | B2 * | 7/2010 | Hartselle | 422/400 |
| 2003/0044323 | A1 * | 3/2003 | Diamond et al. | 422/102 |
| 2012/0134895 | A1 * | 5/2012 | Kanda et al. | 422/534 |
| 2013/0146216 | A1 * | 6/2013 | Mileti | B29D 22/02 156/197 |

* cited by examiner

*Primary Examiner* — Jill Warden
*Assistant Examiner* — Dwayne K Handy

(57) ABSTRACT

In one embodiment described herein, a cartridge is provided comprising a cartridge frame; a plurality of diluents each in an expandable container; a plurality of reagents each in an expandable container; and a plurality of mixing vessels comprising empty expandable containers.

19 Claims, 14 Drawing Sheets

METHODS AND DEVICES FOR SMALL VOLUME LIQUID CONTAINMENT

BACKGROUND

Open top test tube and sample containers will encounter challenges to work effectively in the weightless or microgravity environment found on a space station or on a spacecraft. The liquid, once placed in the vessel, will cling to the bottom due to capillary forces regardless of the container orientation, making it problematic for extracting the liquid. Additionally, small movements of the test tube and sample containers will cause the liquid to spill or float free from the vessel's open top due to capillary forces being weaker than the inertial forces resulting from vessel motion. These two facts make current art in containers impractical in a weightless environment.

Current containers and liquid handling techniques have limitations, particularly when dealing in a weightless or microgravity environment and handling small liquid volumes in a highly accurate manner suitable for laboratory testing.

INCORPORATION BY REFERENCE

All publications, patents, and patent applications mentioned in this specification are herein incorporated by reference to the same extent as if each individual publication, patent, or patent application was specifically and individually indicated to be incorporated by reference.

COPYRIGHT

This document contains material subject to copyright protection. The copyright owner (Applicant herein) has no objection to facsimile reproduction of the patent documents and disclosures, as they appear in the US Patent and Trademark Office patent file or records, but otherwise reserves all copyright rights whatsoever. The following notice shall apply: Copyright 2013-2014 Theranos, Inc.

SUMMARY

The disadvantages associated with the prior art are overcome by embodiments described herein. At least some of these embodiments may be advantageous in a weightless, microgravity, or other environment where it is desirable to more actively control liquid handling.

In at least one embodiment described herein, a fluid container is provided comprising: a bulk portion; a liquid capture portion extending along a portion of the bulk portion; and a cover portion defining an access port in fluidic communication with both the bulk portion and the liquid capture portion.

In at least one embodiment described herein, a fluid container is provided comprising: an expandable bulk portion; a capillary portion extending along a portion of the bulk portion; wherein the capillary portion is substantially non-expandable.

In at least one embodiment described herein, a device is provided comprising an outer vessel; an inner vessel comprising an expandable portion substantially contained within the outer vessel; and a tip receiving portion fluidically coupled to the expandable portion.

In at least one embodiment described herein, a device is provided comprising an expandable portion; and a fluid sealing receiving portion.

In at least one embodiment described herein, a cartridge is provided comprising a cartridge frame; a plurality of diluents each in an expandable container; a plurality of reagents each in an expandable container; and a plurality of mixing vessels comprising empty expandable containers.

In one embodiment described herein, a method of liquid handling is provided, the method comprising: expanding a liquid containing portion to define a cavity; leaving a portion of the liquid in a pipette receiving area to maintain a fluid head in a liquid entry area whereby risk of bubble entry into the pipette is minimized.

It should be understood that embodiments in this disclosure may be adapted to have one or more of the features described below. In one non-limiting example, the vessel can hold no more than about 30 microliters or less of liquid. Optionally the vessel can hold no more than about 50 microliters or less of liquid. Optionally the vessel can hold no more than about 70 microliters or less of liquid. Optionally the vessel can hold no more than about 100 microliters or less of liquid. Optionally, the expandable vessel has a neutral bias provided in terms of expelling or drawing liquid into the vessel. By way of non-limiting example, this can be achieved in part by material thickness and/or material selection. Optionally, a method may involve pressurizing space between the outer vessel and the inner vessel to compress the inner vessel and direct liquid out of the inner vessel. Optionally, a method may involve depressurizing space between the outer vessel and the inner vessel to expand the inner vessel and draw liquid into the inner vessel. Optionally, at least a portion of the inner vessel is coupled to the outer vessel. Optionally, the liquid capture portion comprises a capillary portion. Optionally, the liquid capture portion comprises a capillary channel. Optionally, the liquid capture portion comprises an open capillary channel. Optionally, the liquid capture portion comprises a liquid wicking channel. Optionally, the liquid capture portion comprises a liquid directing channel. Optionally, the liquid capture portion comprises a meniscus elongation structure. Optionally, the liquid capture portion comprises a meniscus shaping structure. Optionally, the liquid capture portion comprises a surface tension based liquid shaping structure to draw a portion of liquid in fluid communication to extend away from a bulk portion of the liquid. Optionally, there is only a single access port into the container. Optionally, there are multiple access ports into the container. Optionally, lower portions are coated with a hydrophobic material to encourage flow towards an orifice. Optionally, a plurality of expandable containers are housed in a common outer vessel. Optionally, a plurality of expandable containers are housed in a common outer vessel. Optionally, a method comprises pressurizing an outer container to exert pressure on collapsible container.

It should be understood that embodiments in this disclosure may be adapted to have one or more of the features described below. In one nonlimiting example, when in a weightless environment, the vessel comprises at least one channel formed by an acute angle running along the vessel side from the bottom to the rim. Optionally, an inside wall surface material that is wetting or partially wetting to the liquids defined by the advancing contact angle less than 90 degrees. Optionally, flexible walls define the channel so that by flexing the walls, the acute angle can be decreased. Optionally, a coating on the vessel is provided on an inside wall surface, particularly the channel, that is wetting or partially wetting to the liquids defined by the advancing contact angle less than 90 degrees. Optionally, surface roughness is used on the vessel inside which alters the effective wetting to the liquids. Optionally, surface roughness is used in the liquid capture portion, which alters the effective wetting to the liquids. Optionally, a closed top portion is adjacent a rim of the vessel. Optionally, an entire top portion of the vessel is closed except through an access port or location in fluid communication with the liquid capture portion. Optionally, the rim delimits a size and a shape of the open top corresponding to a size and a shape of a closed bottom. Optionally, a first sidewall is provided; a second sidewall coupled to the first sidewall continuously along a common vertical axis and forming an acute angle with a sharp vertex between the first sidewall and the second sidewall, the common vertical axis extending continuously between a closed bottom and an open top. Optionally, a curvilinear rear wall disposed opposite from the common vertical axis and integrally joining the first sidewall and the second sidewall. Optionally, a cavity defined by a continuous interior surface bounded by a curvilinear rear wall and an open top, the continuous interior surface extending downward from the sharp vertex in a curvilinear direction, the cavity capable of containing and dispensing a liquid disposed in the cavity when the container is located in a weightless environment. Optionally, a continuous interior surface is substantially wetting along the common vertical axis when the liquid is being dispensed by a user in the weightless environment. Optionally, the cavity is bounded by the first sidewall and the second sidewall, the first sidewall and the second sidewall are flexible, thereby enabling adjustment of the acute angle along the sidewall and at the rim. Optionally, a coating is disposed on the continuous interior surface. Optionally, the continuous interior surface is a rough surface which alters the effective wetting along the common vertical axis. Optionally, an orifice sealing member is provided to close an orifice on the container. Optionally, an exterior located container-deforming mixing device. Optionally, a bubble detection system is used to determine quality of fluid pipetting. Optionally, the vessel may have a bulk fluid zone and a capillary fluid zone. Optionally, a fluid impermeable barrier defines at least one surface of a mixing zone.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DESCRIPTION OF THE SPECIFIC EMBODIMENTS

Figure 1A:
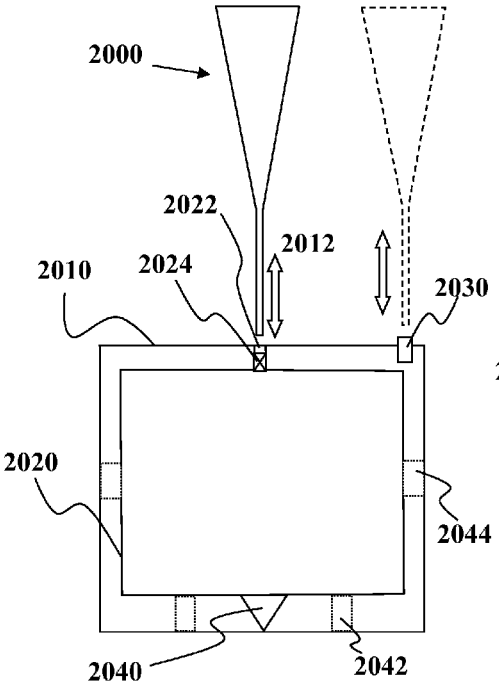
FIGS. 1A-1E show various embodiments described herein.

Embodiments of devices, systems, and methods for cell analysis may be found, for example, in U.S. Pat. No. 8,380,541; U.S. Patent Application 61/837,151, filed Jun. 19, 2013, entitled "DEVICES, SYSTEMS, AND METHODS FOR CELL ANALYSIS IN MICROGRAVITY"; U.S. Patent Application 61/837,168, filed Jun. 19, 2013, entitled "METHODS AND DEVICES FOR SMALL VOLUME LIQUID CONTAINMENT"; U.S. Patent Application 61/837,627, filed Jun. 20, 2013, entitled "METHODS AND DEVICES FOR SMALL VOLUME LIQUID CONTAINMENT"; U.S. Patent Application 61/837,167, filed Jun. 19, 2013, entitled "METHODS AND DEVICES FOR SAMPLE ANALYSIS"; U.S. Pat. App. Ser. No. 61/676,178, filed Jul. 26, 2012; U.S. Pat. App. Ser. No. 61/766,116, filed Feb. 18, 2013; U.S. Pat. App. Ser. No. 61/802,194, filed Mar. 15, 2013; U.S. patent application Ser. No. 13/769,798, filed Feb. 18, 2013; U.S. patent application Ser. No. 13/769,779, filed Feb. 18, 2013; U.S. patent application Ser. No. 13/244,947 filed Sep. 26, 2011; PCT/US2012/57155, filed Sep. 25, 2012; U.S. application Ser. No. 13/244,946, filed Sep. 26, 2011; U.S. patent application Ser. No. 13/244,949, filed Sep. 26, 2011; and U.S. Application Ser. No. 61/673,245, filed Sep. 26, 2011, the disclosures of which patents and patent applications are all hereby incorporated by reference in their entireties.

It is to be understood that both the foregoing general description and the following detailed description are exemplary and explanatory only and are not restrictive of the invention, as claimed. It may be noted that, as used in the specification and the appended claims, the singular forms "a", "an" and "the" include plural referents unless the context clearly dictates otherwise. Thus, for example, reference to "a material" may include mixtures of materials, reference to "a compound" may include multiple compounds, and the like.

It is further noted that, as used in the specification and the appended claims, "or", as used in "A or B", refers to each of A; B; and A and B; that is, use of the word "or" includes "and/or" unless the context or an explicit statement clearly dictates otherwise. Thus, for example, reference to "treatment of cells or substrate" may include treatment of cells alone; treatment of substrate alone; and treatment of both cells and substrate.

References cited herein are hereby incorporated by reference in their entirety, except to the extent that they conflict with teachings explicitly set forth in this specification.

In this specification and in the claims which follow, reference will be made to a number of terms which shall be defined to have the following meanings:

"Optional" or "optionally" means that the subsequently described circumstance may or may not occur, so that the description includes instances where the circumstance occurs and instances where it does not. For example, if a device optionally contains a feature for a sample collection unit, this means that the sample collection unit may or may not be present, and, thus, the description includes both structures wherein a device possesses the sample collection unit and structures wherein sample collection unit is not present.

As used herein, the terms "substantial" means more than a minimal or insignificant amount; and "substantially" means more than a minimally or insignificantly. Thus, for example, the phrase "substantially different", as used herein, denotes a sufficiently high degree of difference between two numeric values such that one of skill in the art would consider the difference between the two values to be of statistical significance within the context of the characteristic measured by said values. Thus, the difference between two values that are substantially different from each other is typically greater than about 10%, and may be greater than about 20%, preferably greater than about 30%, preferably greater than about 40%, preferably greater than about 50% as a function of the reference value or comparator value.

As used herein, the term "point of service location" may include locations where a subject may receive a service (e.g. testing, monitoring, treatment, diagnosis, guidance, sample collection, ID verification, medical services, non-medical services, etc.), and may include, without limitation, a subject's home, a subject's business, the location of a healthcare provider (e.g., doctor), hospitals, emergency rooms, operating rooms, clinics, health care professionals' offices, laboratories, retailers [e.g. pharmacies (e.g., retail pharmacy, clinical pharmacy, hospital pharmacy), drugstores, supermarkets, grocers, etc.], transportation vehicles (e.g. car, boat, truck, bus, airplane, motorcycle, ambulance, mobile unit, fire engine/truck, emergency vehicle, law enforcement vehicle, police car, or other vehicle configured to transport a subject from one point to another, etc.), traveling medical care units, mobile units, schools, day-care centers, security screening locations, combat locations, health assisted living residences, government offices, office buildings, tents, bodily fluid sample acquisition sites (e.g. blood collection centers), sites at or near an entrance to a location that a subject may wish to access, sites on or near a device that a subject may wish to access (e.g., the location of a computer if the subject wishes to access the computer), a location where a sample processing device receives a sample, or any other point of service location described elsewhere herein.

As used herein, "gravity" refers to the acceleration due to the mass of the Earth (or, where relevant, other celestial object such as, e.g., the sun, the moon, or a planet).

As used herein, "one g", and "g" refer to the acceleration due to the Earth's gravitation field. One g is approximately equal to 9.8 m/sec$^2$ (32 feet/sec$^2$).

As used herein, the "force of gravity" refers to the force experience by an object due to its presence on Earth. The magnitude of the force of gravity experiences by an object is determined by the mass of that object multiplied by the acceleration due to Earth's mass (this force is also termed the object's "weight").

As used herein, "microgravity" refers to conditions where the effective force of gravity acting on an object is very small as compared to the force of gravity that would affect the object when the object is at rest or moving at constant velocity on or near the surface of the earth. A falling object near the surface of the earth experiences microgravity; hence, the term "free-fall" is sometimes used to refer to that form of microgravity. An object in orbit around the earth or other celestial body experiences microgravity. An object en route between celestial bodies, not subject to imposed accelerations (as occur, e.g., during firing of a rocket motor) experiences microgravity. Objects experience little or no gravitational force in microgravity, and their motion is not significantly affected or directed by gravity under such conditions. Thus, objects at rest in microgravity do not fall, nor do particles within liquids settle to any significant extent, in the absence of the exertion of another force acting on the objects or particles.

As used herein, the term "biological sample" refers to a fluid, tissue, or other material collected from a subject. Examples of biological samples include but are not limited to, blood, serum, plasma, bone marrow, a nasal swab, a nasopharyngeal wash, saliva, urine, gastric fluid, spinal fluid, tears, stool, mucus, sweat, earwax, oil, a glandular secretion, cerebral spinal fluid, tissue, semen, vaginal fluid, interstitial fluids derived from tumorous tissue, ocular fluids, spinal fluid, a throat swab, breath, hair, finger nails, skin, biopsy, placental fluid, amniotic fluid, cord blood, lymphatic fluids, cavity fluids, sputum, pus, microbiota, meconium, breast milk and/or other secretions or excretions. Biological samples may include nasopharyngeal wash, or other fluid obtained by washing a body cavity or surface of a subject, or by washing a swab following application of the swab to a body cavity or surface of a subject. Nasal swabs, throat swabs, stool samples, hair, finger nail, ear wax, breath, and other solid, semi-solid, or gaseous samples may be processed in an extraction buffer, e.g., for a fixed or variable amount of time, prior to their analysis. The extraction buffer or an aliquot thereof may then be processed similarly to other fluid samples if desired. Examples of tissue samples of the subject may include but are not limited to, connective tissue, muscle tissue, nervous tissue, epithelial tissue, cartilage, cancerous sample, or bone. The sample may be obtained from a human or animal. The sample may be obtained from a vertebrate, e.g., a bird, fish, or mammal, such as a rat, a mouse, a pig, an ape, another primate (including humans), a farm animal, a sport animal, or a pet. The sample may be obtained from a living or dead subject. The sample may be obtained fresh from a subject or may have undergone some form of pre-processing, storage, or transport.

The terms "blood" and "whole blood" refer to blood as it exists within an animal and as directly obtained from a subject in a blood sample. Blood contains red blood cells, white blood cells, proteins such as albumin, globulins, and clotting factors, salts, water, and other constituents.

The terms "plasma" and "blood plasma" refer to the liquid portion of blood (e.g., a blood sample) that remains after the removal of blood cells. Red blood cells and white blood cells may be removed by centrifugation of a blood sample, leaving plasma above the pelleted cells in the bottom of the centrifuge tube. Plasma retains blood clotting factors, and is obtained from anti-coagulated blood samples.

The terms "serum" and "blood serum" refer to the liquid portion of blood that remains after blood is allowed to clot, and the clot is removed. Serum differs from plasma in that serum lacks clotting factors: since clotting requires fibrin, thrombin, and other proteins, which form and remain part of a blood clot, serum lacks these proteins while plasma contains them.

As used herein, a "finger-stick" refers to: i) the act of making a small puncture in the skin of a subject, allowing a small amount (e.g., a droplet, or one, two, or a few drops) of blood to flow and become available for collection; ii) the puncture itself; and iii) the blood collected thereby. Blood may be liberated in a finger-stick, for example, by use of a lancet or other sharp implement effective to pierce the skin of a subject. Typically, only a small amount of blood is collected in this way (e.g., the amount of blood may be about 250 μL or less, or about 200 μL or less, or about 150 μL or less, or about 100 μL or less, or about 50 μL or less, or about 25 μL or less, or about 15 μL or less, or about 10 μL or less, or about 10 μL or less, or about 5 μL or less, or about 3 μL or less, or about 1 μL or less). Blood from a finger-stick may be collected, e.g., by needle, syringe, capillary tube, or other method. Blood from a finger-stick may be collected for transport to another location; for storage prior to use or analysis; for immediate use; or for a combination of the same.

As used herein, a "sample" may be but is not limited to a blood sample, or a portion of a blood sample, may be of any suitable size or volume, and is preferably of small size or volume. In some embodiments of the assays and methods disclosed herein, measurements may be made using a small volume blood sample, or no more than a small volume portion of a blood sample, where a small volume comprises no more than about 5 mL; or comprises no more than about 3 mL; or comprises no more than about 2 mL; or comprises no more than about 1 mL; or comprises no more than about 500 μL; or comprises no more than about 250 μL; or comprises no more than about 100 μL; or comprises no more than about 75 μL; or comprises no more than about 50 μL; or comprises no more than about 35 μL; or comprises no more than about 25 μL; or comprises no more than about 20 μL; or comprises no more than about 15 μL; or comprises no more than about 10 μL; or comprises no more than about 8 μL; or comprises no more than about 6 μL; or comprises no more than about 5 μL; or comprises no more than about 4 μL; or comprises no more than about 3 μL; or comprises no more than about 2 μL; or comprises no more than about 1 μL; or comprises no more than about 0.8 μL; or comprises no more than about 0.5 μL; or comprises no more than about 0.3 μL; or comprises no more than about 0.2 μL; or comprises no more than about 0.1 μL; or comprises no more than about 0.05 μL; or comprises no more than about 0.01 μL.

Fluid Handling System

A device may be part of a system, a component of which may be a sample processing device. A device may be a sample processing device. A sample processing device may be configured to facilitate collection of a sample, prepare a sample for a clinical test, or effect a chemical reaction with one or more reagents or other chemical or physical processing, as disclosed herein. A sample processing device may be configured to obtain data from a sample. A sample processing device may be configured to transmit data obtained from a sample. A sample processing device may be configured to analyze data from a sample. A sample processing device may be configured to communicate with another device, or a laboratory, or an individual affiliated with a laboratory, to analyze data obtained from a sample.

A sample processing device may be configured to be placed in or on a subject. A sample processing device may be configured to accept a sample from a subject, either directly or indirectly. A sample may be, for example, a biological sample, e.g., of blood, urine, sputum, material obtained from a nasal swab, a throat swab, a cheek swab, or other sample, (e.g., a sample obtained from a fingerstick, or from venipuncture, or an arterial biological sample, e.g., of blood, urine, sputum, material obtained from a nasal swab, a throat swab, a cheek swab, or other sample,), a urine sample, a biopsy sample, a tissue slice, stool sample, or other biological sample; a water sample, a soil sample, a food sample, an air sample; or other sample. A biological sample, e.g., of blood, urine, sputum, material obtained from a nasal swab, a throat swab, a cheek swab, or other sample, may comprise, e.g., whole blood, plasma, or serum. A sample processing device may receive a sample from the subject through a housing of the device. The sample collection may occur at a sample collection site, or elsewhere. The sample may be provided to the device at a sample collection site.

In some embodiments, a sample processing device may be configured to accept or hold a cartridge. In some embodiments, a sample processing device may comprise a cartridge. The cartridge may be removable from the sample processing device. In some embodiments, a sample may be provided to the cartridge of the sample processing device. Alternatively, a sample may be provided to another portion of a sample processing device. The cartridge and/or device may comprise a sample collection unit that may be configured to accept a sample.

A cartridge may include a sample, and may include reagents for use in processing or testing a sample, disposables for use in processing or testing a sample, or other materials. Following placement of a cartridge on, or insertion of a cartridge into, a sample processing device, one or more components of the cartridge may be brought into fluid communication with other components of the sample processing device. For example, if a sample is collected at a cartridge, the sample may be transferred to other portions of the sample processing device. Similarly, if one or more reagents are provided on a cartridge, the reagents may be transferred to other portions of the sample processing device, or other components of the sample processing device may be brought to the reagents. In some embodiments, the reagents or components of a cartridge may remain on-board the cartridge. In some embodiments, no fluidics are included that require tubing or that require maintenance (e.g., manual or automated maintenance).

A sample or reagent may be transferred to a device, such as a sample processing device. A sample or reagent may be transferred within a device. Such transfer of sample or reagent may be accomplished without providing a continuous fluid pathway from cartridge to device. Such transfer of sample or reagent may be accomplished without providing a continuous fluid pathway within a device. In embodiments, such transfer of sample or reagent may be accomplished by a sample handling system (e.g., a pipette); for example, a sample, reagent, or aliquot thereof may be aspirated into an open-tipped transfer component, such as a pipette tip, which may be operably connected to a sample handling system which transfers the tip, with the sample, reagent, or aliquot thereof contained within the tip, to a location on or within the sample processing device. The sample, reagent, or aliquot thereof can be deposited at a location on or within the sample processing device. Sample and reagent, or multiple reagents, may be mixed using a sample handling system in a similar manner. One or more components of the cartridge may be transferred in an automated fashion to other portions of the sample processing device, and vice versa.

A device, such as a sample processing device, may have a fluid handling system (also termed herein a sample handling system). A fluid handling system may perform, or may aid in performing, transport, dilution, extraction, aliquotting, mixing, and other actions with a fluid, such as a sample. In some embodiments, a fluid handling system may be contained within a device housing. A fluid handling system may permit the collection, delivery, processing and/or transport of a fluid, dissolution of dry reagents, mixing of liquid and/or dry reagents with a liquid, as well as collection, delivery, processing and/or transport of non-fluidic components, samples, or materials. The fluid may be a sample, a reagent, diluent, wash, dye, or any other fluid that may be used by the device, and may include, but not limited to, homogenous fluids, different liquids, emulsions, suspensions, and other fluids. A fluid handling system, including without limitation a pipette, may also be used to transport vessels (with or without fluid contained therein) around the device. The fluid handling system may dispense or aspirate a fluid. The sample may include one or more particulate or solid matter floating within a fluid.

In embodiments, a fluid handling system may comprise a pipette, pipette tip, syringe, capillary, or other component. The fluid handling system may have portion with an interior surface and an exterior surface and an open end. The fluid handling system may comprise a pipette, which may include a pipette body and a pipette nozzle, and may comprise a pipette tip. A pipette tip may or may not be removable from a pipette nozzle. In embodiments, a fluid handling system may use a pipette mated with a pipette tip; a pipette tip may be disposable. A tip may form a fluid-tight seal when mated with a pipette. A pipette tip may be used once, twice, or more times. In embodiments, a fluid handling system may use a pipette or similar device, with or without a pipette tip, to aspirate, dispense, mix, transport, or otherwise handle the fluid. The fluid may be dispensed from the fluid handling system when desired. The fluid may be contained within a pipette tip prior to being dispensed, e.g., from an orifice in the pipette tip. In embodiments, or instances during use, all of the fluid may be dispensed; in other embodiments, or instances during use, a portion of the fluid within a tip may be dispensed. A pipette may selectively aspirate a fluid. The pipette may aspirate a selected amount of fluid. The pipette may be capable of actuating stirring mechanisms to mix the fluid within the tip or within a vessel. The pipette may incorporate tips or vessels creating continuous flow loops for mixing, including of materials or reagents that are in non-liquid form. A pipette tip may also facilitate mixture by metered delivery of multiple fluids simultaneously or in sequence, such as in 2-part substrate reactions.

A fluid handling system may include one or more fluidically isolated or hydraulically independent units. For example, the fluid handling system may include one, two, or more pipette tips. The pipette tips may be configured to accept and confine a fluid. The tips may be fluidically isolated from or hydraulically independent of one another. The fluid contained within each tip may be fluidically isolated or hydraulically independent from one fluids in other tips and from other fluids within the device. The fluidically isolated or hydraulically independent units may be movable relative to other portions of the device and/or one another. The fluidically isolated or hydraulically independent units may be individually movable. A fluid handling system may comprise one or more base or support. A base or support may support one or more pipette or pipette units. A base or support may connect one or more pipettes of the fluid handling system to one another.

A sample processing device may be configured to perform processing steps or actions on a sample obtained from a subject. Sample processing may include sample preparation, including, e.g., sample dilution, division of a sample into aliquots, extraction, contact with a reagent, filtration, separation, centrifugation, or other preparatory or processing action or step. A sample processing device may be configured to perform one or more sample preparation action or step on the sample. Optionally, a sample may be prepared for a chemical reaction and/or physical processing step. A sample preparation action or step may include one or more of the following: centrifugation, separation, filtration, dilution, enriching, purification, precipitation, incubation, pipetting, transport, chromatography, cell lysis, cytometry, pulverization, grinding, activation, ultrasonication, micro column processing, processing with magnetic beads, processing with nanoparticles, or other sample preparation action or steps. For example, sample preparation may include one or more step to separate blood into serum and/or particulate fractions, or to separate any other sample into various components. Sample preparation may include one or more step to dilute and/or concentrate a sample, such as a biological sample, e.g., of blood, urine, sputum, material obtained from a nasal swab, a throat swab, a cheek swab, or other sample, or other biological samples. Sample preparation may include adding an anti-coagulant or other ingredients to a sample. Sample preparation may also include purification of a sample. In embodiments, all sample processing, preparation, or assay actions or steps are performed by a single device. In embodiments, all sample processing, preparation, or assay actions or steps are performed within a housing of a single device. In embodiments, most sample processing, preparation, or assay actions or steps are performed by a single device, and may be performed within a housing of a single device. In embodiments, many sample processing, preparation, or assay actions or steps are performed by a single device, and may be performed within a housing of a single device. In embodiments, sample processing, preparation, or assay actions or steps may be performed by more than one device.

A sample processing device may be configured to run one or more assay on a sample, and to obtain data from the sample. An assay may include one or more physical or chemical treatments, and may include running one or more chemical or physical reactions. A sample processing device may be configured to perform one, two or more assays on a small sample of bodily fluid. One or more chemical reaction may take place on a sample having a volume, as described elsewhere herein. For example one or more chemical reaction may take place in a pill having less than femtoliter volumes. In an instance, the sample collection unit is configured to receive a volume of the bodily fluid sample equivalent to a single drop or less of blood or interstitial fluid. In embodiments, the volume of a sample may be a small volume, where a small volume may be a volume that is less than about 1000 μL, or less than about 500 μL, or less than about 250 μL, or less than about 150 μL, or less than about 100 μL, or less than about 75 μL, or less than about 50 μL, or less than about 40 μL, or less than about 20 μL, or less than about 10 μL, or other small volume. In embodiments, all sample assay actions or steps are performed on a single sample. In embodiments, all sample assay actions or steps are performed by a single device. In embodiments, all sample assay actions or steps are performed within a housing of a single device. In embodiments, most sample assay actions or steps are performed by a single device, and may be performed within a housing of a single device. In embodiments, many sample assay actions or steps are performed by a single device, and may be performed within a housing of a single device. In embodiments, sample processing, preparation, or assay actions or steps may be performed by more than one device.

A sample processing device may be configured to perform a plurality of assays on a sample. For example, a sample processing device may be configured to detect, or to identify, or to measure pathogen-identifying material in a sample. In embodiments, a sample processing device may be configured to perform a plurality of assays on a single sample. In embodiments, a sample processing device may be configured to perform a plurality of assays on a single biological sample, where the biological sample is a small sample. For example, a small sample may have a sample volume that is a small volume of less than about 1000 μL, or less than about 500 μL, or less than about 250 μL, or less than about 150 μL, or less than about 100 μL, or less than about 75 μL, or less than about 50 μL, or less than about 40 μL, or less than about 20 μL, or less than about 10 μL, or other small volume. A sample processing device may be capable of performing multiplexed assays on a single sample. A plurality of assays may be run simultaneously; may be run sequentially; or some assays may be run simultaneously while others are run sequentially. One or more control assays and/or calibrators (e.g., including a configuration with a control of a calibrator for the assay/tests) can also be incorporated into the device; control assays and assay on calibrators may be performed simultaneously with assays performed on a sample, or may be performed before or after assays performed on a sample, or any combination thereof. In embodiments, all sample assay actions or steps are performed by a single device. In embodiments, all of a plurality of assay actions or steps are performed within a housing of a single device. In embodiments, most sample assay actions or steps, of a plurality of assays, are performed by a single device, and may be performed within a housing of a single device. In embodiments, many sample assay actions or steps, of a plurality of assays, are performed by a single device, and may be performed within a housing of a single device. In embodiments, sample processing, preparation, or assay actions or steps may be performed by more than one device.

In embodiments, all of a plurality of assays may be performed in a short time period. In embodiments, such a short time period comprises less than about three hours, or less than about two hours, or less than about one hour, or less than about 40 minutes, or less than about 30 minutes, or less than about 25 minutes, or less than about 20 minutes, or less than about 15 minutes, or less than about 10 minutes, or less than about 5 minutes, or less than about 4 minutes, or less than about 3 minutes, or less than about 2 minutes, or less than about 1 minute, or other short time period.

A sample processing device may be configured to detect one or more signals relating to the sample. A sample processing device may be configured to identify one or more properties of the sample. For instance, the sample processing device may be configured to detect the presence or concentration of one analyte or a plurality of analytes or a disease condition in the sample (e.g., in or through a bodily fluid, secretion, tissue, or other sample). Alternatively, the sample processing device may be configured to detect a signal or signals that may be analyzed to detect the presence or concentration of one or more analytes (which may be indicative of a disease condition) or a disease condition in the sample. The signals may be analyzed on board the device, or at another location. Running a clinical test may or may not include any analysis or comparison of data collected.

A chemical reaction or other processing step may be performed, with or without the sample. Examples of steps, tests, or assays that may be prepared or run by the device may include, but are not limited to immunoassay, nucleic acid assay, receptor-based assay, cytometric assay, colorimetric assay, enzymatic assay, electrophoretic assay, electrochemical assay, spectroscopic assay, chromatographic assay, microscopic assay, topographic assay, calorimetric assay, turbidimetric assay, agglutination assay, radioisotope assay, viscometric assay, coagulation assay, clotting time assay, protein synthesis assay, histological assay, culture assay, osmolarity assay, and/or other types of assays, centrifugation, separation, filtration, dilution, enriching, purification, precipitation, pulverization, incubation, pipetting, transport, cell lysis, or other sample preparation action or steps, or combinations thereof. Steps, tests, or assays that may be prepared or run by the device may include imaging, including microscopy, cytometry, and other techniques preparing or utilizing images. Steps, tests, or assays that may be prepared or run by the device may further include an assessment of histology, morphology, kinematics, dynamics, and/or state of a sample, which may include such assessment for cells.

A device may be capable of performing all on-board steps (e.g., steps or actions performed by a single device) in a short amount of time. A device may be capable of performing all on-board steps on a single sample in a short amount of time. For example, from sample collection from a subject to transmitting data and/or to analysis may take about 3 hours or less, 2 hours or less, 1 hour or less, 50 minutes or less, 45 minutes or less, 40 minutes or less, 30 minutes or less, 20 minutes or less, 15 minutes or less, 10 minutes or less, 5 minutes or less, 4 minutes or less, 3 minutes or less, 2 minutes or less, or 1 minute or less. The amount of time from accepting a sample within the device to transmitting data and/or to analysis from the device regarding such a sample may depend on the type or number of steps, tests, or assays performed on the sample. The amount of time from accepting a sample within the device to transmitting data and/or to analysis from the device regarding such a sample may take about 3 hours or less, 2 hours or less, 1 hour or less, 50 minutes or less, 45 minutes or less, 40 minutes or less, 30 minutes or less, 20 minutes or less, 15 minutes or less, 10 minutes or less, 5 minutes or less, 4 minutes or less, 3 minutes or less, 2 minutes or less, or 1 minute or less.

A device may be configured to prepare a sample for disposal, or to dispose of a sample, such as a biological sample, following processing or assaying of a sample.

A transport system may be used to move components, devices, or other parts and materials from one location to another, e.g., from one location to another within a device or within a housing of a device or system. In embodiments, a transport system may move components, devices, or other parts and materials from one location to another within a system or within a housing enclosing a system.

A transport system may have other capabilities or uses; for example a transport system may comprise a dual-use system including, for example, fluid transport capabilities as well as transport capabilities. For example, a fluid transport system may comprise a dual-use system having transport capabilities as well as fluid transport capabilities.

Small Volume Sample Vessel(s)

Referring now to FIG. 1A, one embodiment of a sample vessel will now be described. FIG. 1 shows that there may be an access device 2000 such as but not limited to a pipette tip that is configured for use with a sample handling system such as described herein and has a distal portion for use with vessel 2010. In this non-limiting example, the vessel 2010 may be an outer vessel that may be a rigid vessel. Optionally, it may be made of a transparent material. Optionally, some embodiments may use an opaque material to protect any light sensitive materials therein. Optionally, some embodiments may use a translucent material.

Some embodiments may be use a first material that is coated or shielded such as with a paint, polymer, mylar, and/or metal foil. As indicated by arrow 2012, the access device 2000 may be inserted and withdrawn as desired to perform desire liquid handling procedures. By way of non-limiting example, one embodiment may have one pipette tip deliver a first liquid into the vessel 2020, withdraw, and then have a second pipette tip deliver a second liquid into the same vessel 2020. In this embodiment, mixing may then occur through pipette aspiration and/or external mixing elements. In this non-limiting example, the mixed liquids may be then be extracted from vessel 2020 in the same or different pipette tip or other access device.

This embodiment of FIG. 1A shows that there is an inner vessel 2020 that is contained within the vessel 2010. Inner vessel 2020 in this embodiment has an access portion 2022 that may include a fluid sealing member 2024. In one non-limiting example, the fluid sealing member 2024 may be a valve. Optionally, fluid sealing member 2024 may be a septa that is re-sealable. For devices with septum on top, pTFE may be used as the material and slit to form a re-sealable closing mechanism. In some embodiments, other liquid tight and optionally re-sealable members may also be used. Some embodiments may include one or more vents 2030 to allow for expansion of the expandable vessel 2020 without resistance from an otherwise sealed environment provide by vessel 2010. In some embodiments, the vent 2030 may be an orifice. Optionally, it may be a one way valve letting gas out. Optionally, it may be a one way valve letting gas in. Optionally, it may be a two way valve. Optionally, it may be configured to be engaged by another pipette tip (shown in phantom in FIG. 1A) or similar apparatus to provide a controlled pressurization of the environment between vessels 2010 and 2020. Optionally, it should be understood that some embodiments may have a vessel 2010 with an open bottom portion in which case the vessel 2010 does not provide a seal environment in those embodiments.

Referring still to FIG. 1A, it should be understood that some embodiments herein may use one or more attachment devices or units 2040 to secure the vessel 2020 in at least one degree of freedom relative to vessel 2010. As seen in FIG. 1A, there may be an attachment unit 2040 to attach the bottom of vessel 2020 to the vessel 2010. Optionally, there may be other attachment units 2042 and 2044 used to secure bottom and/or side portions of the vessel 2020 relative to vessel 2010.

Figure 1B:
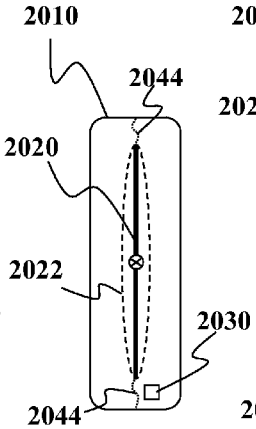

Referring now to FIG. 1B, a top-down view of one embodiment of FIG. 1A shall now be described. In this top down view, the vessel 2020 may be seen in a flat, unexpanded configuration. Outline 2022 (shown in phantom) shows that upon delivery of sufficient liquid volume, the vessel 2020 may expand into a shape such as but not limited to that indicated by the outline 2022. It should be understood that this outline 2022 is merely exemplary and the size of the expansion depends in part on the amount of liquid delivered into the vessel 2020. FIG. 1B shows that one expansion mode of the vessel 2020 is to have an oval horizontal cross-sectional shape. Of course, through use of the shape of vessel 2020 and/or other devices, other shapes can also be achieved.

Figure 1C:
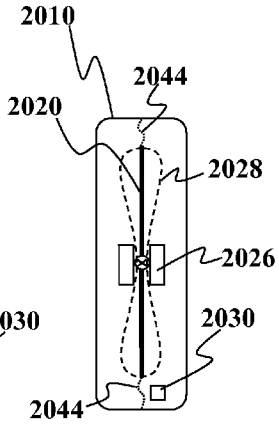

Referring now to FIG. 1C, a top-down view of another embodiment of FIG. 1A shall now be described. This embodiment of FIG. 1C shows that through molding of the vessel 2020 and/or the use of external shapers 2026, the expanded configuration of vessel 2020 in this embodiment may be a dumb-bell shaped horizontal cross-section as indicated by outline 2028 (shown in phantom). This embodiment creates a capillary zone near the center of the vessel 2020 which can be helpful to draw fluid toward an extraction point. In some embodiments, this narrowing extends like a column through the vessel 2020. Optionally, only certain portions of the vessel 2020 as adapted to have this cross-sectional shape. Optionally, it is only along a top portion. Optionally, it is only in a top and middle portion. Optionally, it is only in a middle and lower portion. Optionally, it is only in a lower portion. It should be understood that to have the vessel 2020 be returned to a flat shape, some embodiments may use vacuum on an interior of the vessel 2020 and/or pressure outside the vessel 2020 to push liquid or gas out of the vessel 2020 to achieve a flat shape shown in FIG. 1C. In some embodiment, this is done before liquid is introduced into the vessel 2020 by access device 2000 and/or after liquid is withdrawn from the vessel 2020. It should be understood that this flattening of an expandable vessel can be adapted for use with any of the embodiments described herein.

Figure 1D:
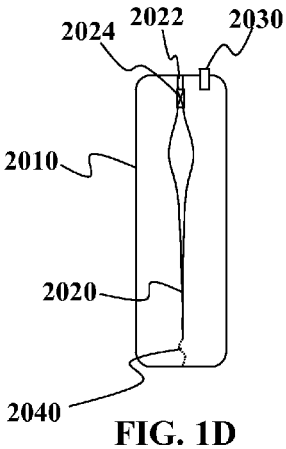

Referring now to FIG. 1D, a side view of one embodiment of FIG. 1A will now be described. FIG. 1D shows a first side profile of the vessel 2020 wherein the bolus of liquid creating an expanded outline of vessel 2020 is configured to remain near a top portion of the vessel near the access portion 2022. This can be useful to extract liquid easily from the vessel.

Figure 1E:
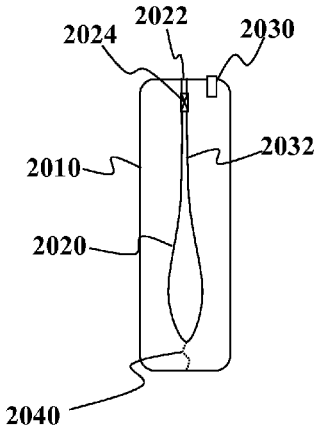

Referring now to FIG. 1E, a side view of another embodiment of FIG. 1A will now be described. FIG. 1E shows a first side profile of the vessel 2020 wherein the bolus of liquid creating an expanded outline of vessel 2020 is configured to remain near a bottom portion of the vessel near the access portion 2022. The narrow portion 2032 can be useful as it can use surface tension to maintain some fluid near the extraction point provided by access portion 2022.

In some embodiments, it is desirable that there is no air or gas that is delivered into the expandable vessel 2020. With no gas pockets or bubbles in the vessel 2020, there is reduced risk of a break in fluid transfer between the access device 2000 and the vessel which can cause a miscalculation in volume of liquid being transferred. This can be particularly desirable when dealing with low volumes of liquid such as but not limited to no more than about 150 microliters or less. Optionally, the volumes of liquid in the vessel are no more than about 120 microliters or less. Optionally, the volumes of liquid in the vessel are no more than about 100 microliters or less. Optionally, the volumes of liquid in the vessel are no more than about 80 microliters or less. Optionally, the volumes of liquid in the vessel are no more than about 60 microliters or less. Optionally, the volumes of liquid in the vessel are no more than about 50 microliters or less. Optionally, the volumes of liquid in the vessel are no more than about 40 microliters or less. Optionally, the volumes of liquid in the vessel are no more than about 30 microliters or less. Optionally, the volumes of liquid in the vessel are no more than about 20 microliters or less. Optionally, the volumes of liquid in the vessel are no more than about 10 microliters or less. Optionally, the volumes of liquid in the vessel are no more than about 5 microliters or less.

Figure 2A:
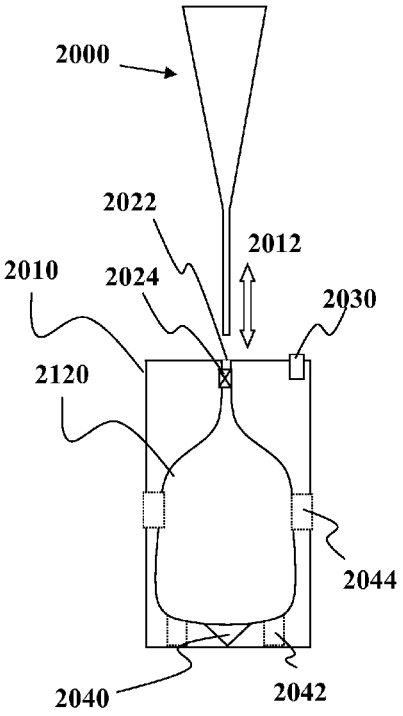
FIGS. 2A-2C show various embodiments described herein.
Figure 2B:
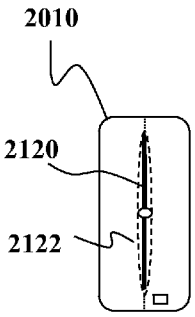
Figure 2C:
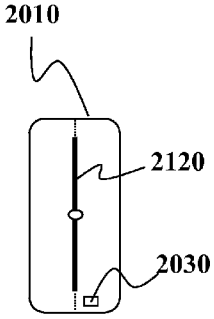

Referring now to FIGS. 2A-2C, a still further embodiment of a liquid containment vessel will now be described. FIG. 2A shows that the vessel 2120 is not limited to a rectangular shape and can have a variety of other shapes such as but not limited to a pear shape as shown in FIG. 2A. It should be understood that other geometric shapes for the vertical cross-section such as but not limited to circular, teardrop, dumbbell, triangular, hexagonal, polygonal, diamond, oval, square, single or multiple combinations of the foregoing are possible.

FIG. 2B shows that the expanded mode can be elliptical. It should also be known that other shapes such as circular, teardrop, dumbbell, triangular, hexagonal, polygonal, diamond, oval, square, single or multiple combinations of the foregoing are possible and not excluded. FIG. 2C shows the vessel 2120 returned to a flat shape, as viewed from top down.

Figure 3A:
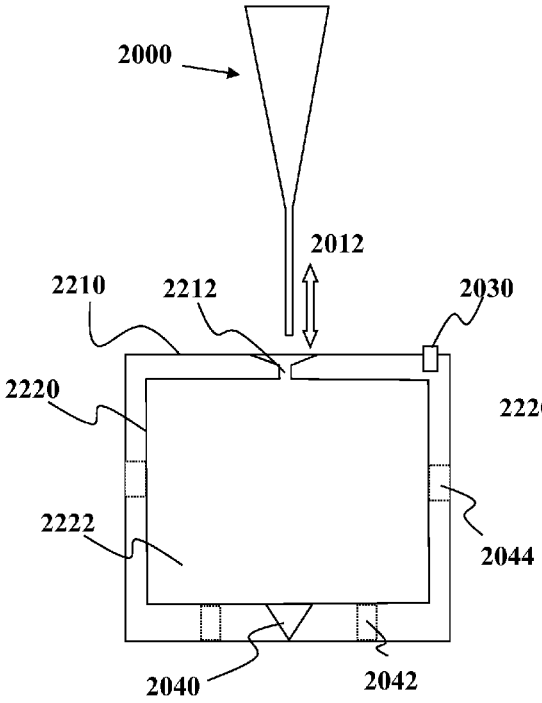
FIGS. 3A-3C show various embodiments described herein.
Figure 3B:
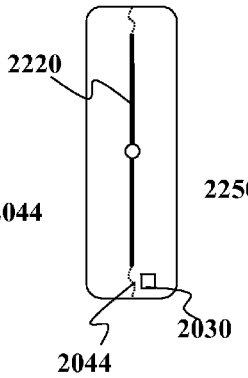
Figure 3C:
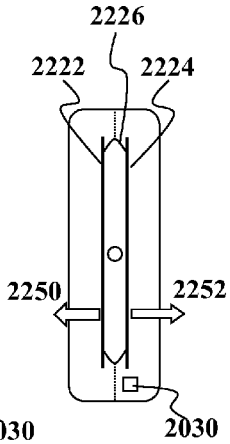

Referring to FIGS. 3A-3C, a still further embodiment of a liquid containment vessel will now be described. FIG. 3A shows that the vessel 2210 contains an expandable vessel 2220 having rigid side walls 2222 and 2224 (see FIG. 3C). This can be particularly useful if the rigid side walls 2222 and 2224 are also optically transparent. In this non-limiting example, the vessel 2220 is also optically transparent. This can allow the liquid therein to be interrogated for their optical properties such as but not limited to their colorimetric, absorbance, turbidity, or other optically discernible characteristic. FIG. 3A also shows that some embodiments may simply use an access port 2212 although use of a valve is not excluded in other embodiments. FIG. 3A also shows a funneled opening that allows for ease of tip alignment and sample collection.

It should be understood that some embodiments may use rails, guides or other devices to ensure that the plates remain parallel to each other when liquid is in the vessels 2220 and causes plates to expand away from each other as seen in FIG. 3C and indicated by arrows 2250 and 2252. Between the plates 2222 and 2224 may be a flexible liner 2226 that helps contain the liquid therein. In embodiments, entire assembly including vessels 2210 and 2220 are moved to a detector station. Optionally, in some embodiments, the detector is brought to the vessels 2210 and 2220. It should be understood that to have the vessel 2220 be returned to a flat shape, some embodiments may use vacuum on an interior of the vessel 2220 and/or pressure outside the vessel 2220 to push liquid or gas out of the vessel 2220 to achieve a flat shape shown in FIG. 3B. In some embodiment, this is done before liquid is introduced into the vessel 2220 by access device 2000 and/or after liquid is withdrawn from the vessel 2220. It should be understood that this flattening of an expandable vessel can be adapted for use with any of the embodiments described herein.

Figure 4A:
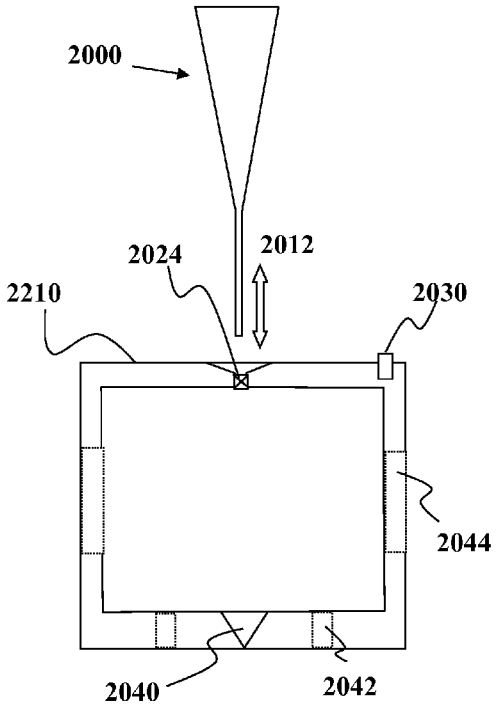
FIGS. 4A-4C show various embodiments described herein.
Figure 4B:
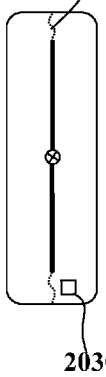
Figure 4C:
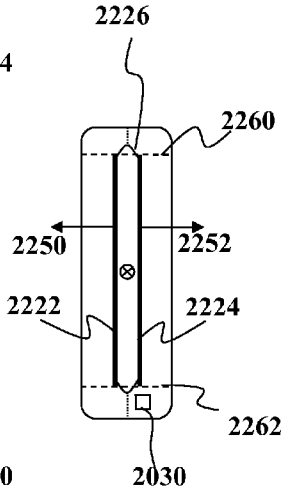

Referring to FIGS. 4A-4C, a still further embodiment of a liquid containment vessel will now be described. These embodiments are similar to that of FIGS. 3A-3C except that an access device 2024 may be included. FIG. 4C also shows that rails 2260 and 2262 (shown in phantom) can be used to guide the plates 2222 and 2224 for their movement apart and together. It should also be understood that in some embodiments plates 2222 and 2224 move apart and maintain a parallel orientation relative to each other. Optionally, some embodiments may hinge (top, bottom, right side, or left side) one edge such that the plates 2222 and 2224 move away from each other in a hinged, non-parallel manner. It should also be understood that in some embodiments plates 2222 and 2224 are used to control the expansion as liquid is delivered into the vessel and not for optically purposes. Thus in some embodiments, one or both plates 2222 and 2224 are opaque. Optionally, one plate 2222 may have a mirrored inner surface while the other plate 2224 is transparent.

Figure 5A:
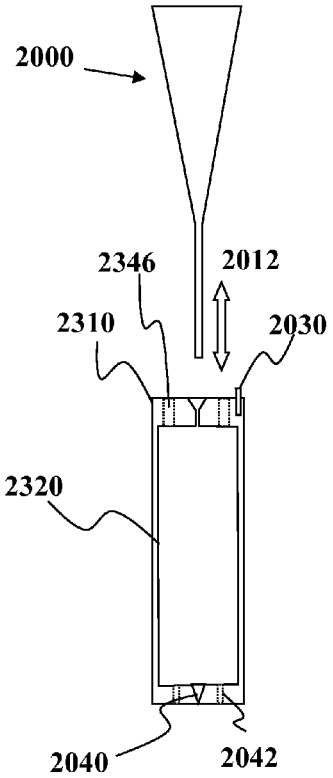
FIGS. 5A-5B show various embodiments described herein.
Figure 5B:
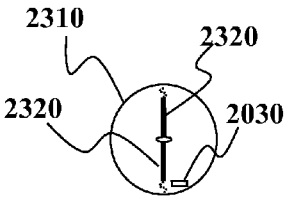

Referring to FIGS. 5A-5B, a still further embodiment of a liquid containment vessel will now be described. This embodiment uses a vessel 2310 that may be suitable for use in centrifuge. The aspect ratio in terms of height to width can be configured to more easily be accommodated in a centrifuge device. There may also be attachments 2346 to hold the expandable vessel 2320 along a top of the vessel 2310. Optionally, some embodiments may also include a separator gel in the vessel 2320 to keep materials separated after centrifugation. The vessel 2310 can be movable to bring the vessel to a centrifuge or other processing station.

Figure 6A:
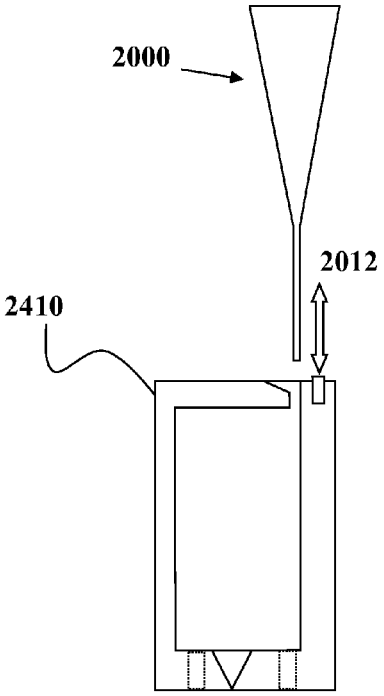
FIGS. 6A-6B show various embodiments described herein.
Figure 6B:
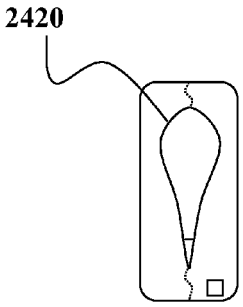

Referring now to FIGS. 6A-6B, a still further embodiment of a liquid containment vessel will now be described. This embodiment shows that the access portion 2022 can be offset to one side of the vessel 2410. FIG. 6A shows that this puts the access device 2000 to one side of the inner vessel 2420. In one embodiment, the vessel 2420 is expandable similar to that shown in FIGS. 1-5. Optionally, another embodiment of vessel 2420 has the vessel as a rigid or semi-rigid vessel such that it substantially maintains the cross-sectional shape as seen in FIG. 6B. Optionally, another embodiment has only a liquid collection portion 2440 as a rigid portion while a bulk liquid containing portion 2450 is expandable. It should be understood that the top of the vessel 2420 has a closed top except for the access portion 2022.

Optionally, the access device 2000 can have a tip that extends at least into the vessel 2430. Optionally, access device 2000 can have a tip that extends at least about half ways into the vessel 2430. Optionally, access device 2000 can have a tip that extends to substantially the bottom of the vessel 2430. This type of access device can be adapted for use with any of the embodiments herein.

Figure 7A:
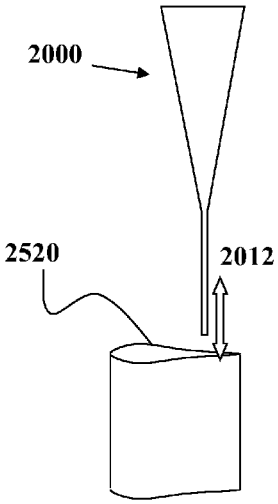
FIGS. 7A-7C show various embodiments described herein where a vessel has at least a bulk storage portion and a wicking portion.
Figure 7B:
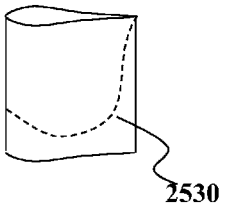
Figure 7C:
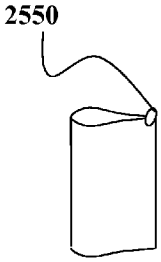
Figure 8A:
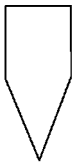
FIGS. 8A-8E show various embodiments of cross-sectional described herein.
Figure 8B:
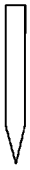
Figure 8C:
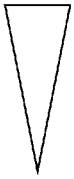
Figure 8D:
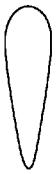
Figure 8E:
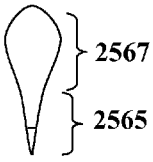

Referring now to FIGS. 7A to 7C, other embodiments of vessels 2520 similar to the vessel 2420 in the embodiment of FIG. 6B are now shown. FIG. 7B shows a shaped interior surface 2530 within the vessel 2520 to guide flow therein. These may be rigid, partial rigid, or part rigid/part expandable vessels in the manner as described for vessel 2420. Optionally, some may be fully flexible. It should be understood that the top of the vessel 2520 can be a closed top except for the access portion 2022 or it can be open as shown. FIG. 7C shows that there may be collection area 2550.

Referring now to FIGS. 8A-8E, other embodiments show top down views of cross-sectional shapes of vessel(s) are shown. Again, these may be rigid, partial rigid, or part rigid/part expandable vessels in the manner as described for vessel 2420. Optionally, some may be fully flexible. Some embodiments may have one or more cross-sectional shapes along the length of the vessel. Of course, other cross-sectional shapes such as but not limited to those with a narrowed area 2565 for "wicking" liquid and a bulk containment area 2567 may be used.

Figure 9A:
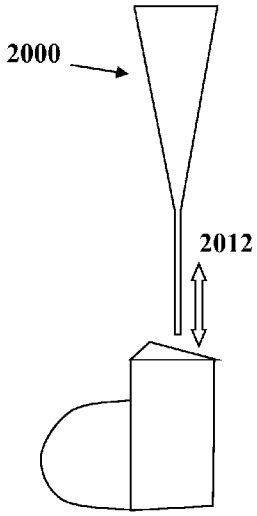
FIGS. 9A-11D show various embodiments of a vessel interacting with an access device.
Figure 9B:
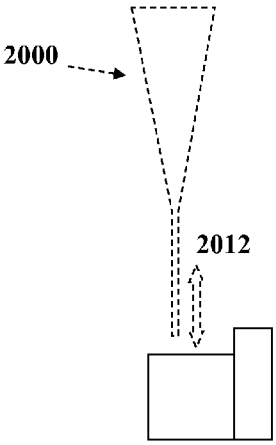
Figure 9C:
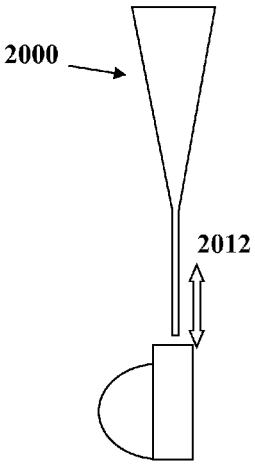

FIGS. 9A-9C shows how various areas of the vessel can be engaged by access device 2000. By way of non-limiting example, the access device 2000 may be a pipette or other liquid handling device. In the non-limiting examples of FIGS. 9A-9C, the access device 2000 may be raised or lowered as indication by arrow 2012. It should be understood that the top of the vessel can be a closed top except for the access portion 2022 or it can be open as shown.

Figure 10A:
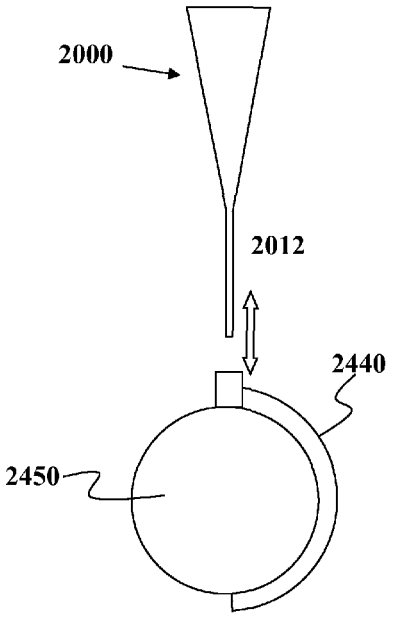
Figure 10B:
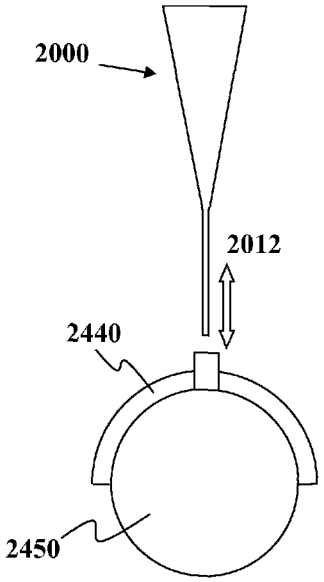

FIGS. 10A-10B show embodiments where the liquid capture portion 2450 may be channel located at various locations around the bulk liquid containment area to enable liquid to be drawn upwards therein.

Figure 11A:
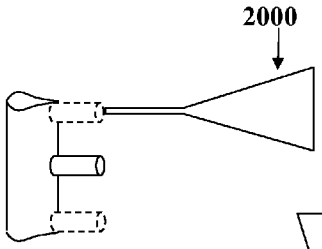
Figure 11B:
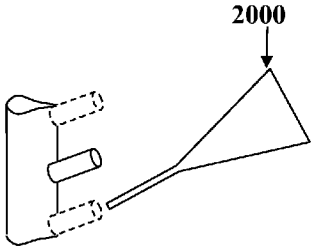
Figure 11C:
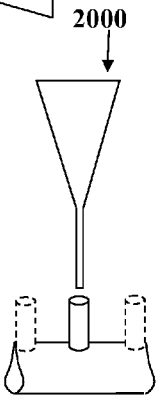
Figure 11D:
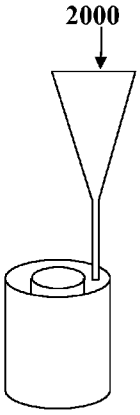

FIGS. 11A-11D show other embodiments with access ports at various locations along a liquid capture portion or edge of the vessel. FIGS. 11A-11D show that the access port may be an elongate member with various locations (as shown in phantom). Some embodiments may have multiple access ports. FIG. 11D shows that some embodiments may use a vessel with an annular cross-sectional shape with the access device 2000 interacting with the portion that is defined between the two walls of the outer and inner perimeters.

Figure 12:
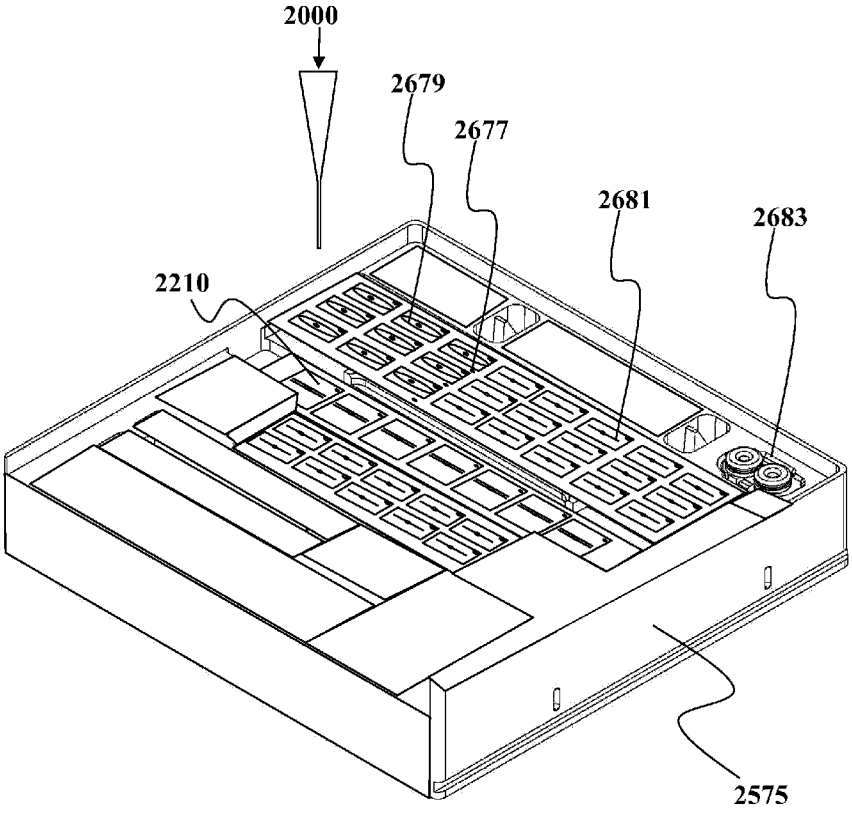
FIG. 12 shows a perspective view of a support device such as a cartridge for housing one or more embodiments of vessels described herein.

FIG. 12 shows a cartridge frame 2575 have a plurality of different vessels in the cartridge. Some may be filled some may be empty. Different sized pouches or vessels may be used in the array. Some embodiments may position vents 2677 on the cartridge frame. The vents 2677 may be connected to allow gas around an expandable vessel to exit. As seen in FIG. 12, some container vessels 2679 are filled while others 2681 may be empty to be filled or to act as mixing vessels. It should be understood that some embodiments may use a combination of rigid vessels and non-rigid vessels. FIG. 12 shows that in one embodiment, a location 2683 is provided on the cartridge frame for holding one or more vessels (rigid, non-rigid vessels, or non-rigid vessels with a rigid portion such as at the cartridge interface). The cartridge frame may optionally include a cover to cover all, a majority, or select portions of the cartridge frame. Some embodiments may have a configuration that does not cover the location 2683.

In one non-limiting example, the cartridge frame along with everything thereon is inserted into a sample processing device, a sample analyzer, or other hardware instrument for using at least the materials thereon for process the sample(s).

Figure 13A:
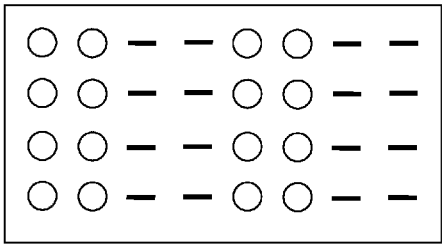
FIGS. 13A-13D show various view of non-limiting embodiments described herein.
Figure 13B:
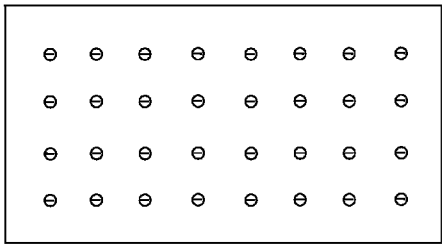
Figure 13C:
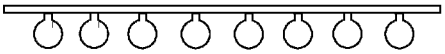
Figure 13D:
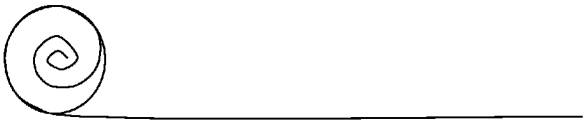

FIGS. 13A-D show that a plate may have a plurality of different expanded and unexpanded vessels therein. FIG. 13A is bottom up view of vessels in a support media. Some are shown in a collapsed configuration while others are shown in an expanded configuration (shown as circles in FIG. 13A). FIG. 13B is a top down view of septa openings to the vessels on the support media. FIG. 13C shows a side view. These may be stacked in vertical manner to from columns of these plate arrays. These can also be beneficial in that when in empty condition, the plates can stack in a substantially reduced volume, flat configuration. FIG. 13D shows a tape embodiment where there may be long arrays of these empty vessels attached to the tape. These may be filled by arrays of pipette tips to simultaneous fill many of the vessels at one time. Optionally, the tape can be cut so that a desired number of vessels are on the tape and can be deployed into cartridges.

Figure 14A:
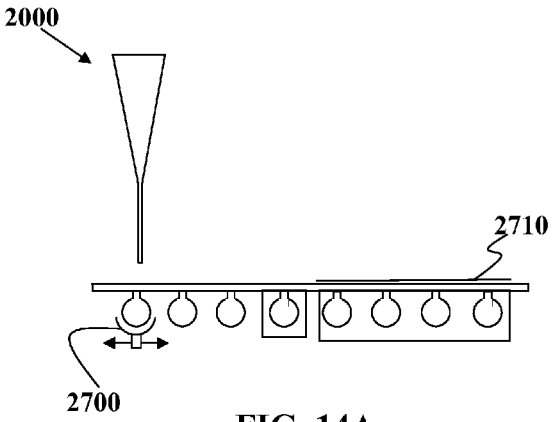
FIGS. 14A-14C show various view of non-limiting embodiments described herein.
Figure 14B:
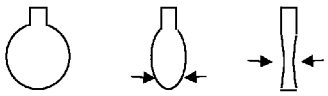
Figure 14C:
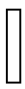

FIGS. 14A-14C show that an external mixing device can engage an underside of the vessels. One may use mixing vessels 2700 as seen in FIG. 14A that may be scaled down versions of external mixers to engage one or more the vessels simultaneously. FIG. 14A also shows that one, some, or all of the vessels may be sealed by a layer of material 2710 such as but not limited to foil, mylar, plastic, or the like to preserve integrity of material therein. FIG. 14B shows various stages of expansion and/or compression of the expandable vessel. FIG. 14C shows a tubular expandable vessel. Some embodiments may have pump(s), compressor(s), peristaltic pump(s), pistons, or other actuator to interact with the non-rigid vessel(s) to either create flow into the vessel, flow out of the vessel, or mixing.

Figure 15A:
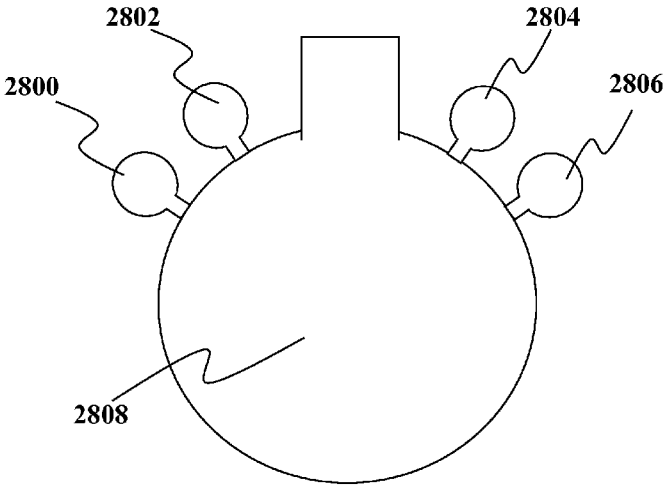
FIGS. 15A and 15B show exemplary embodiments of vessels with additional container coupled thereto.
Figure 15B:
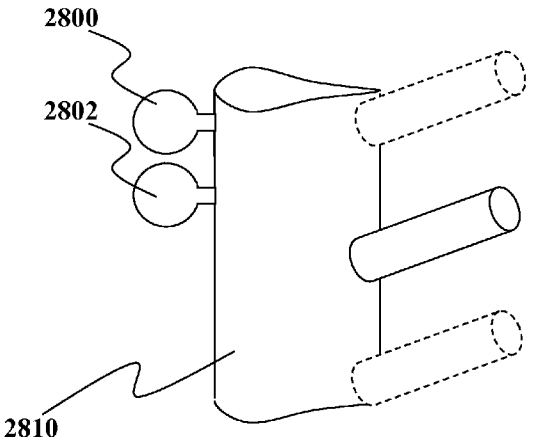

Referring now to FIGS. 15A and 15B, it should be understood that any of the embodiments herein may be adapted to include rigid or soft containers 2800 to 2806 which may contain other materials such as but not limited to additive(s), catalyst(s), preservative(s), cyro-preservation material(s), or other material that might be used for sample preparation, sample preservation, sample processing, sample reaction, or the like. These container(s) 2800-2806 may be fluidically isolated from the other portion 2808 of the vessel until it is desirable to bring them together. By way of non-limiting example, there may be burstable seal, ultrasonic weld, valve, or other openable fluidic separator currently known or developed in the future that will maintain separation until time comes to bring materials together. Although many embodiments herein contemplate not only liquid but also material in other phases or forms (solid, gas, semi-solid, etc. . . . ) that can be added to the material in area 2808. It should be understood that some embodiments may have at least one or more of the containers 2800 to 2806 within the perimeter of the vessel instead of extending beyond the perimeter as shown in FIGS. 15A and 15B. Optionally, some may comprise of container(s) within the portion 2808 of the vessel, wherein the container(s) may have a pathway, burstable configuration, or the like to release material into the portion 2808 when pressed, pumped, or otherwise actuated.

FIG. 15B shows another embodiment with a vessel similar to that of FIG. 11B wherein a plurality of containers 2800 and 2802 are positioned to be operable to deliver material into the area 2810 of the vessel, when such combination is desired. As seen in FIG. 15B, this embodiment may position the containers 2800 and 2802 on a bulk holding portion of the vessel and not along a narrow cross-section area where "wicking" may occur. It should be understood that some embodiments may optionally position the containers 2800 and/or 2802 to inlet in the narrowed cross-sectional area. It should be understood that these vessels may be configured to be vessels used as part of a cartridge such as that shown in FIG. 12, as individual or grouped vessels outside a cartridge, or a stand alone vessels used for mixing, supplying materials, or for receiving excess, unused, or waste material. Some of these vessels may be used for storage wherein the opening into them may be sealed or otherwise closed for storage such as but not limited to when cryo-preservation or other preservation material is added to material in the vessel. This may allow for further post processing while minimizing degradation of the sample and/or any analytes therein. By way of non-limiting example, the closure of an opening into the vessel may be a plug, valve, stopper, cap, weld, ultrasonic weld, film, adhesive film, tape, or other closure process or mechanism. Some embodiments may condition the vessels for storage such as through chemical, temperature, or other control techniques. Some embodiments may use different preservation techniques for different vessels in the same cartridge. Some may bulk treat all of the vessels in the cartridge for the same preservation technique.

Optionally, some embodiment may use seals over multi-well cuvette perhaps with vents with each well to allow fluid to be inserted into the wells, but with seals to prevent spillage. Some embodiments may use a separator gel in the vessel to separate liquids after centrifugation. It should be understood that in weightless environments, it is desirable to secure at least some if not all vessels with hook and loop type fasteners (such as Velcro), magnets, or other tie down for all vessels and/or cartridges to stationary surfaces. Similar attachment devices may also be used for attaching vessels to a cartridge. Cartridge attachment to an analytical device or equipment can also use similar attachment techniques.

As seen herein, some embodiments of the sample containment vessels herein can have a bulk zone and a capillary zone. Optionally, some embodiments may have a fixed capillary zone and an expandable bulk zone. Optionally, some embodiments may have a capillary siphon zone and a mixing zone. Optionally, some embodiments of the sample containment vessels may be configured to be engaged by two or more pipettes such that each pipette engages at least one vessel. Optionally, some embodiments configured to be engaged by multiple pipettes where one pipette engages a vessel while another engages a vent to an exterior of the vessel. Some embodiments may have a cuvette or test tube configured to be engaged by two or more pipette tips at one time. Some embodiments may use multiple dispense of multiple liquids into an expandable vessel to do mixing.

Optionally, to minimize the risk of inaccurate pipetting while in weightlessness, some instruments may have detection systems to deal with bubbles entering into the pipette tip. Some may use optical systems to detect bubbles. Some embodiments may have fluid path devices that separate bubbles from the path and prevent entry into the pipette tip. Optionally, to avoid issues with bubbles or undesired air inclusion, some embodiments may use a precise depth control of the pipette tip into each expandable container. Optionally, some embodiments may never fully empty each expandable vessel so that there is always a bit of a fluid head in the expandable vessel to ensure that no air or gas is accidentally drawn into the pipette tip. Optionally, some expandable vessels are anchored to another object such as the outer vessel, the cartridge, or the like, to prevent the vessel from floating in an uncontrolled manner. Optionally, some expandable vessels are biased to push liquid outward from its interior but this force may be stopped by stopper or other resistor. Optionally, some expandable vessels are neutral relative to pressure in a pipette tip. In some embodiments, flexible member comprises a durable and flexible plastic, such as for example, a polyethylene, or a polypropylene copolymer. Some may use an infused material for the expandable vessel. The material may be infused with antibiotics, anti-coagulants, or other material. Optionally, the expandable vessel may be any suitable shape, such as but not limited to ellipsoidal or polygonal cross-sectional shapes. Suitable materials may include but are not limited to polyethylene, polypropylene, or mylar. Optionally, the thickness in one embodiment may be in the range of about 1 mil to about 2 mils. Optionally, the methods of forming these vessels may involve heat sealing one or more layers together, molding the expandable vessel, or the like. Some may use specific color and/or opacity of material to preserve integrity of liquid in the expandable vessel.

In one embodiment, a vessel for use in a weightless or microgravity environment where the vessel has at least one channel defined by a corner with an included angle with channel so placed that it runs along the vessel side from the vessel bottom to the vessel rim. In the absence of significant gravitational force, capillary forces between the liquid and the vessel wall allow the liquid to creep along the channel and be in near proximity to the open vessel rim. Only a small quantity of liquid is contained in the channel with the bulk of the liquid remaining at the vessel bottom and held in place by capillary forces. The liquid creeps with demand along the channel, replenished from the bulk of the liquid at the bottom of the vessel. This channel, thus conducts the liquid via capillary forces from the bottom of the vessel to the rim until the liquid has been consumed.

In one embodiment, the liquid flows along the side of the vessel channel in weightlessness due to capillary forces where the flow will stop at the rim upon reaching a free surface defined by capillary force equilibrium, without undue spillage of liquid from the open vessel top. In this non-limiting example, the liquid is thus controlled due to capillary forces acting over the highly curved equilibrium free surface shape and thus prevents undue spillage or release of free floating spheres of liquid.

Capillary forces induce the flow of liquid along the channel defined by an included angle. While mathematical theory will predict that the channel angle can have a value greater than 90 degrees, for customary liquids showed that the channel angle may be acute, such as about 40 degrees due to the vessel walls.

In general, in one more aspect, the invention requires a wetting condition or partially wetting condition between the liquid and the material of construction making up the vessel wall which is generally defined by a contact angle less than about 90 degrees. Moreover, the wetting or partially wetting condition may be defined by the advancing contact angle being less than about 90 degrees, with preference given to wall materials that have advancing contact angles less than about 60 degrees for a practical vessel.

In general, in one more aspect, the invention is enhanced by having flexible channel walls so when pinched, the channel angle can be temporarily decreased to a small value. An additional advantage of flexible walls is to temporarily reduce the channel angle to a small value when emptying the vessel which causes the last few drops of liquid to be directed from the vessel bottom to the vessel rim where the residual liquid can then be extracted leaving the vessel in a state of near dryness.

The liquid free surface profile 108 consists of a channel profile 109 which holds only a small fraction of the liquid and a curved bottom profile 110 where the bulk of the liquid resides in the vessel. Capillary forces maintain the channel profile 109 by driving new liquid from the bottom profile 110 as the liquid is drawn.

Optionally, some embodiments may make the walls defining channel 101 out of a flexible material so that angle 102 can be temporarily decreased to 102*a* by pinching the walls defining channel 101 which changes surface profile to 109*a*.

The theoretical conditions required for capillary movement in the absence of significant gravitational force in a two-sided open channel are given by Equation (1) from Concus, P., Finn, R., On the Behavior of a Capillary Free Surface in a Wedge, Proc. Nat. Acad. Sci. U.S.A. Vol. 63, No. 2, June 1969, pp. 292-299:

PHI.<2(90.degree.−.theta.sub.adv) Equation (1)

where: PHI. is the included angle between two sides of the channel.theta.sub.adv is the advancing contact angle between the liquid and the wall. If the conditions of Equation (1) are met, capillary forces will move the liquid along the channel until the end is reached where at that point, a local equilibrium profile is established which balances capillary forces and flow stops. Since this is done where gravitational forces are insignificant, there is no mathematical limit on the channel length. There undoubtedly is a practical maximum channel length; however, for the design of a container, there is no practical concern for channel length. Note that the channel angle .PHI. 102 given by Equation (1) is the maximum angle; angles less than this will result in capillary derived motion along the channel and the smaller the angle c .PHI. 102, the stronger the capillary effect that drives the liquid along the channel. Viscous resistance to flow does increase with decreasing channel angle, however, for practice with typical liquids this was found not to be a concern.

Some advancing contact angles for water on a number of common wall materials under practical conditions (not laboratory cleaned walls and not chemically pure water) are: glass about 5-10 degrees, glazed ceramic about 10-50 degrees, polycarbonate plastics about 60-70 degrees, polyethylene about 80 to 95 degrees, polymethyl methacrylate (trade name Plexiglas) about 70-80 degrees, aluminum about 50-70 degrees, stainless steel about 50-70 degrees, and laser-jet printer transparency film about 10-30 degrees. These values were measured by the inventors for wall materials and are consistent with what is reported in the literature (see Adamson, A. W., Physical Chemistry of Surfaces, 3.sup.rd ed., Wiley, 1976, p. 352).

While the invention has been described and illustrated with reference to certain particular embodiments thereof, those skilled in the art will appreciate that various adaptations, changes, modifications, substitutions, deletions, or additions of procedures and protocols may be made without departing from the spirit and scope of the invention. For example, with any of the above embodiments, it should be understood that the embodiments herein may be described in the context of a weightless environment, the small volume containers and their related methods are not limited to such environments and may find use in other environments such as but not limited to terrestrial environments under non-weightless conditions.

Additionally, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a size range of about 1 nm to about 200 nm should be interpreted to include not only the explicitly recited limits of about 1 nm and about 200 nm, but also to include individual sizes such as 2 nm, 3 nm, 4 nm, and sub-ranges such as 10 nm to 50 nm, 20 nm to 100 nm, etc. . . . .

The publications discussed or cited herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed. All publications mentioned herein are incorporated herein by reference to disclose and describe the structures and/or methods in connection with which the publications are cited. The following applications are fully incorporated herein by reference for all purposes:

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. Any feature, whether preferred or not, may be combined with any other feature, whether preferred or not. The appended claims are not to be interpreted as including means-plus-function limitations, unless such a limitation is explicitly recited in a given claim using the phrase "means for." It should be understood that as used in the description herein and throughout the claims that follow, the meaning of "a," "an," and "the" includes plural reference unless the context clearly dictates otherwise. For example, a reference to "an assay" may refer to a single assay or multiple assays. Also, as used in the description herein and throughout the claims that follow, the meaning of "in" includes "in" and "on" unless the context clearly dictates otherwise. Finally, as used in the description herein and throughout the claims that follow, the meaning of "or" includes both the conjunctive and disjunctive unless the context expressly dictates otherwise. Thus, the term "or" includes "and/or" unless the context expressly dictates otherwise.

What is claimed is:

1. A cartridge comprising:

a cartridge frame;

a plurality of expandable containers supported by the cartridge frame, each of said containers is expandable from a substantially flat configuration with substantially no interior cavity to a non-flat configuration when filled with liquid therein and collapsible from the non-flat configuration to the substantially flat configuration when said liquid is removed;

wherein the non-flat configuration has a cross-sectional shape defining:

a bulk portion in a first portion of the cross-sectional shape;

a liquid capture portion in a second portion of the cross-sectional shape, wherein the first portion is wider than the second portion;

wherein each of the containers comprises a cover portion defining an access port in fluidic communication with both the bulk portion and the liquid capture portion;

a plurality of reagents, each of said reagents in one of said expandable containers in the non-flat configuration; and a plurality of mixing vessels comprising empty expandable containers in the substantially flat configuration.

2. The cartridge of claim 1 wherein the containers are each configured to hold about 50 microliters or less of fluid.

3. The cartridge of claim 1 wherein the containers are each configured to have a neutral bias provided by the container in terms of expelling or drawing liquid into the vessel.

4. The cartridge of claim 1 wherein each of the containers comprises at least one space between an outer vessel and an inner vessel that is configured to be pressurized to compress the inner vessel and direct any liquid out of the inner vessel.

5. The cartridge of claim 4 wherein each of the containers comprises at least a portion of the inner vessel is coupled to the outer vessel.

6. The cartridge of claim 1 wherein the liquid capture portion comprises a capillary portion.

7. The cartridge of claim 1 wherein the liquid capture portion comprises a capillary channel.

8. The cartridge of claim 1 wherein the liquid capture portion comprises an open capillary channel.

9. The cartridge of claim 1 wherein the liquid capture portion comprises a liquid wicking channel.

10. The cartridge of claim 1 wherein the liquid capture portion comprises a liquid directing channel.

11. The cartridge of claim 1 wherein the liquid capture portion comprises a meniscus elongation structure.

12. The cartridge of claim 1 wherein the liquid capture portion comprises a meniscus shaping structure.

13. The cartridge of claim 1 wherein the liquid capture portion comprises a surface tension based liquid shaping structure to draw a portion of liquid in fluid communication to extend away from a bulk portion of the liquid.

14. The cartridge of claim 1 wherein there is only a single access port into each of the containers.

15. The cartridge of claim 1 wherein there are multiple access ports into each of the containers.

16. The cartridge of claim 1 wherein lower portions of the bulk portion are coated with a hydrophobic material to encourage flow towards an orifice.

17. The cartridge of claim 1 wherein each of the containers further comprise an inside wall surface material that is wetting or partially wetting to the liquids defined by an advancing contact angle less than 90 degrees.

18. The cartridge of claim 1 wherein each of the containers further comprise a coating on the vessel inside wall surface, particularly the channel, that is wetting or partially wetting to the liquids defined by thean advancing contact angle less than 90 degrees.

19. The cartridge of claim 1 wherein each of the containers comprises a bulk fluid zone and a capillary fluid zone.

* * * * *